US012789964B2

(12) United States Patent
Ebuchi et al.

(10) Patent No.: US 12,789,964 B2
(45) Date of Patent: Nov. 10, 2026

(54) OUTBOARD MOTOR AND BOAT

(71) Applicant: YAMAHA HATSUDOKI KABUSHIKI KAISHA, Iwata (JP)

(72) Inventors: Jun Ebuchi, Shizuoka (JP); Shusui Horie, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 167 days.

(21) Appl. No.: 18/934,516

(22) Filed: Nov. 1, 2024

(65) Prior Publication Data

US 2025/0153830 A1 May 15, 2025

(30) Foreign Application Priority Data

Nov. 9, 2023 (JP) ..... 2023-191231

(51) Int. Cl.
*B63H 20/28* (2006.01)
*B63H 21/17* (2006.01)
*F01P 3/20* (2006.01)

(52) U.S. Cl.
CPC ..... *B63H 20/28* (2013.01); *B63H 20/285* (2013.01); *B63H 21/17* (2013.01); *F01P 3/202* (2013.01)

(58) Field of Classification Search
CPC ..... B63H 20/28; B63H 20/285; B63H 21/17; F01P 3/202
See application file for complete search history.

(56) References Cited

U.S. PATENT DOCUMENTS 4,260,011 A * 4/1981 Brown ..... F01P 3/202 236/34.5
5,383,803 A * 1/1995 Pilgrim ..... F01P 3/202 440/88 HE
5,746,270 A * 5/1998 Schroeder ..... F28F 9/0231 165/41
5,921,829 A * 7/1999 Iwata ..... F01P 3/202 440/89 R (Continued)

FOREIGN PATENT DOCUMENTS

CN 112339961 A 2/2021
EP 3472043 B1 2/2022

(Continued)

OTHER PUBLICATIONS

Official Communication issued in corresponding European Patent Application No. 24209170.0, mailed on May 13, 2025, 5 pages.

*Primary Examiner* — Brian Christopher Delrue
(74) *Attorney, Agent, or Firm* — Keating & Bennett, LLP

(57) ABSTRACT

An outboard motor includes a drive source including an electric motor, a coolant tube through which a coolant to cool the drive source flows, a water tube through which water from outside the outboard motor flows, and a heat exchanger including a coolant flow path through which the coolant from the coolant tube flows and a water flow path through which the water from the water tube flows. At least one of the coolant flow path and the water flow path includes a first flow path, a second flow path lower than the first flow path, and a first bent connector connecting one end of the first flow path and one end of the second flow path. The first flow path includes a first connecting hole connected to an outside of the heat exchanger, and an upper surface inclined upward at an angle toward the first connecting hole.

19 Claims, 8 Drawing Sheets

(56) References Cited

U.S. PATENT DOCUMENTS

| | | | | |
|---|---|---|---|---|
| 7,264,520 | B1 * | 9/2007 | Taylor | F01P 11/08 440/88 HE |
| 12,595,037 | B1 * | 4/2026 | Dharmadhikari | B63H 21/383 |
| 2002/0162643 | A1 * | 11/2002 | Leeson | F28F 9/02 165/41 |
| 2007/0107424 | A1 * | 5/2007 | Wizgall | F01P 3/202 123/196 R |
| 2016/0023741 | A1 * | 1/2016 | Davis | B63H 20/02 440/75 |
| 2016/0039510 | A1 * | 2/2016 | Shomura | B63H 20/14 440/6 |
| 2022/0089261 | A1 * | 3/2022 | Bruestle | B63H 23/321 |
| 2024/0359786 | A1 * | 10/2024 | Ebuchi | B63H 21/21 |
| 2025/0153822 | A1 * | 5/2025 | Ebuchi | B63H 20/001 |
| 2025/0153830 | A1 * | 5/2025 | Ebuchi | B63H 20/28 |
| 2025/0206432 | A1 * | 6/2025 | Tanaka | F01P 5/10 |
| 2025/0256825 | A1 * | 8/2025 | Coller | B63H 20/28 |

FOREIGN PATENT DOCUMENTS

| | | | | |
|---|---|---|---|---|
| EP | 4737307 | A1 * | 5/2026 | B63H 20/001 |
| JP | 2010228528 | A | 10/2010 | |

* cited by examiner 442W
441W
700
706
706
612W
704
E
W

OUTBOARD MOTOR AND BOAT

CROSS REFERENCE TO RELATED APPLICATIONS

This application claims the benefit of priority to Japanese Patent Application No. 2023-191231 filed on Nov. 9, 2023. The entire contents of this application are hereby incorporated herein by reference.

BACKGROUND OF THE INVENTION

1. Field of the Invention

The technologies disclosed herein relate to outboard motors and boats.

2. Description of the Related Art

A boat includes a hull and an outboard motor mounted to a rear portion of the hull. The outboard motor is a device that generates thrust to propel the boat.

There has been known an outboard motor having a drive source including an electric motor and a configuration for cooling the drive source. Specifically, the outboard motor is equipped with a coolant tube through which the coolant that cools the drive source flows, a water tube through which external water flows, and a heat exchanger. Inside the heat exchanger are formed a coolant flow path through which the coolant from the coolant tube flows and a water flow path through which the water from the water tube flows. The upper surface of the coolant flow path extends horizontally toward the coolant inlet/outlet. The upper surface of the water flow path also extends horizontally toward the water inlet/outlet (see, e.g., JP 2010-228528 A).

As mentioned above, in a conventional heat exchanger provided in an outboard motor, both the upper surface of the coolant flow path and the upper surface of the water flow path extend horizontally toward the inlet and outlet for the coolant or water, so that air is likely to be trapped in the coolant path and the water flow path. If air is trapped in the coolant or water flow path, the efficiency of the heat exchange in the heat exchanger may decrease because heat exchange between the coolant and water does not occur in the area where the air is trapped.

SUMMARY OF THE INVENTION

Example embodiments of the present invention disclose technologies that solve one or more of the above-mentioned problems.

The technologies disclosed herein can be implemented in the following example embodiments.

An outboard motor includes a drive source including an electric motor, a coolant tube through which a coolant to cool the drive source flows, a water tube through which water from outside flows, and a heat exchanger including a coolant flow path through which the coolant from the coolant tube flows and a water flow path through which the water from the water tube flows. At least one of the coolant flow path and the water flow path includes a first flow path extending in a direction intersecting an upper-lower direction, a second flow path lower than the first flow path and extending in a direction intersecting the upper-lower direction, and a first bent connector connecting one end of the first flow path and one end of the second flow path. The first flow path includes a first connecting hole connected to an outside of the heat exchanger, and an upper surface defining the first flow path is inclined upward at an angle toward the first connecting hole.

The technologies disclosed herein can be implemented in various example embodiments, including, e.g., as outboard motors, boats provided with outboard motors and hulls, among other implementations, applications, or example embodiments.

According to example embodiments of the outboard motor, it is possible to improve the efficiency of heat exchange in the heat exchanger while reducing or preventing air from being trapped in the flow path inside the heat exchanger.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
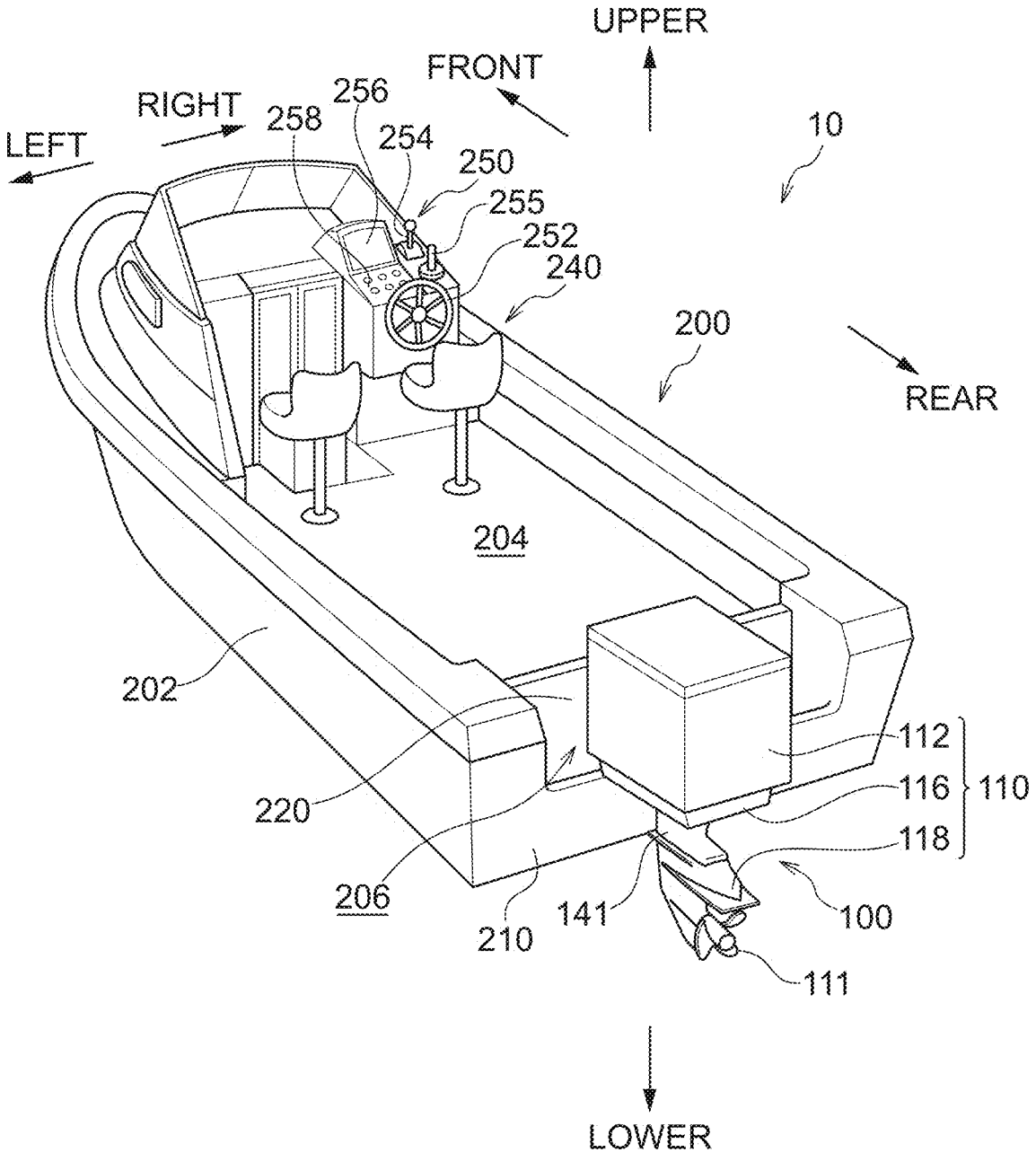
FIG. 1 is a perspective view schematically illustrating a configuration of a boat according to an example embodiment of the present invention.

FIG. 1 is a perspective view schematically illustrating a configuration of a boat 10 according to an example embodiment of the present invention. FIG. 1 and other drawings described below show arrows representing each direction with respect to the position of the boat 10. More specifically, each drawing shows arrows representing the front direction (FRONT), rear direction (REAR), left direction (LEFT), right direction (RIGHT), upper direction (UPPER), and lower direction (LOWER), respectively. The front-rear direction, left-right direction, and upper-lower direction are orthogonal to each other. It should be noted that, in this specification, axes, structures, and the like extending in the front-rear direction need not necessarily be parallel to the front-rear direction. Axes and structures extending in the front-rear direction include axes and structures inclined within the range of ±45° to the front-rear direction. Similarly, axes and structures extending in the upper-lower direction include axes and structures inclined within a range of ±45° to the upper-lower direction, and axes and structures extending in the left-right direction include axes and structures inclined within a range of ±45° to the left-right direction.

The boat 10 includes a hull 200 and an outboard motor 100. In an example embodiment, the boat 10 includes only one outboard motor 100, but the boat 10 may include multiple outboard motors 100.

The hull 200 is a portion of the boat 10 for occupants to ride. The hull 200 includes a hull main body 202 including a living space 204, a pilot seat 240 in the living space 204, and an operating device 250 near the pilot seat 240. The operating device 250 steers the boat and includes, e.g., a steering wheel 252, a shift/throttle lever 254, a joystick 255, a monitor 256, and an input device 258. The hull 200 includes a partition wall 220 to partition the rear end of the living space 204 and a transom 210 disposed at the rear end of the hull 200. In the front-rear direction, a space 206 is provided between the transom 210 and the partition wall 220.

Figure 2:
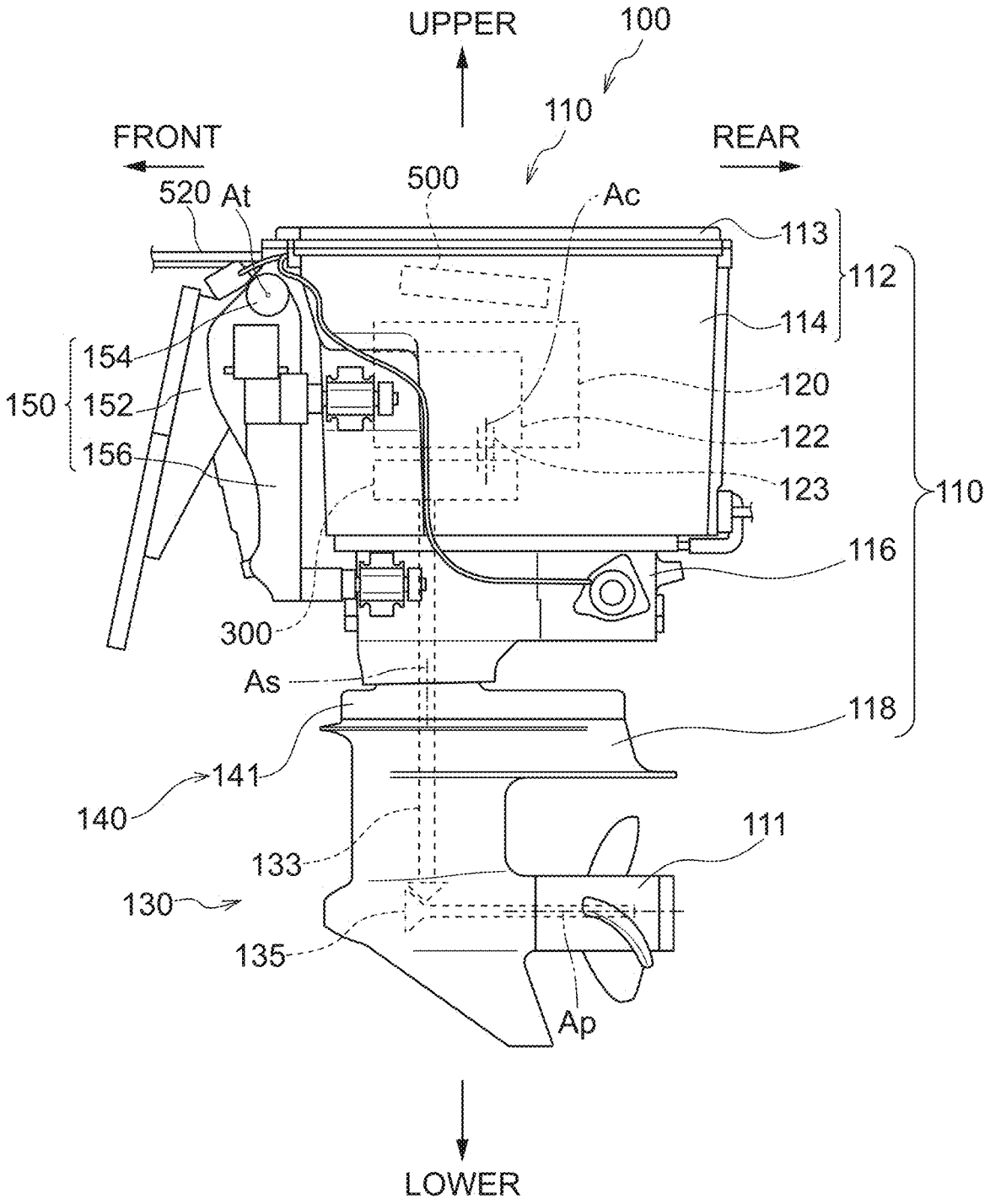
FIG. 2 is a side view schematically illustrating a configuration of an outboard motor according to an example embodiment of the present invention.

FIG. 2 is a side view schematically illustrating a configuration of an outboard motor 100. The outboard motor 100 in the reference attitude will be described below unless otherwise specified. The reference attitude is an attitude in which the rotation axis Ac of the output shaft 123, which will be described below, extends in the upper-lower direction, and the rotation axis Ap of the propeller shaft 135, which will be described below, extends in the front-rear direction. The front-rear direction, the left-right direction, and the upper-lower direction are respectively defined based on the outboard motor 100 in the reference attitude.

The outboard motor 100 generates thrust to propel the boat 10. The outboard motor 100 is attached to the transom 210 at a rear portion of the hull 200. The outboard motor 100 includes an outboard motor main body 110 and a suspension device 150.

The outboard motor main body 110 includes a waterproof case 112, a middle case 116, a lower case 118, a motor assembly 120, a control assembly 500, a transmission mechanism 130, a propeller 111, and a steering mechanism 140.

The waterproof case 112 is a housing located at an upper portion of the outboard motor main body 110. The waterproof case 112 houses an electric motor 122 described below and other electrical components to protect the electric motor 122 and electrical components from being exposed to seawater. The waterproof case 112 includes an upper cover 113 defining an upper portion of the waterproof case 112 and a lower box 114 defining a lower portion of the waterproof case 112. The lower box 114 has a box-shaped configuration with an open top. The upper cover 113 is removably attached to the lower box 114 to cover the top portion (opening) of the lower box 114.

The middle case 116 is a housing located below the waterproof case 112 and arranged near the center of the outboard motor main body 110 in the upper-lower direction. The upper portion of the middle case 116 is connected to the lower box 114 of the waterproof case 112.

The lower case 118 is a housing located below the middle case 116 and arranged at the bottom of the outboard motor main body 110.

The motor assembly 120 is housed inside the waterproof case 112. The motor assembly 120 includes an electric motor 122 as a driving source. The electric motor 122 is a prime mover that generates power. The electric motor 122 includes an output shaft 123 that outputs the driving force generated by the electric motor 122. The output shaft 123 is arranged in an attitude in which its rotation axis Ac extends in the upper-lower direction.

The control assembly 500 is housed inside the waterproof case 112 and located higher than the motor assembly 120. The control assembly 500 controls the rotation of the electric motor 122 and the like.

The transmission mechanism 130 transmits the driving force of the electric motor 122 to the propeller 111. The transmission mechanism 130 includes a primary reduction gear 300, a drive shaft 133, and a propeller shaft 135.

The primary reduction gear 300 is housed inside the waterproof case 112 and is located lower than the motor assembly 120. The primary reduction gear 300 is connected to the output shaft 123 of the electric motor 122 and the drive shaft 133. The primary reduction gear 300 reduces the driving force of the electric motor 122 and transmits it to the drive shaft 133. This allows the propeller 111 to rotate at a desired torque.

The drive shaft 133 is a rod-shaped member that transmits power to the propeller shaft 135 and is arranged in an attitude extending in the upper-lower direction. The drive shaft 133 is housed so that it spans the inside of the waterproof case 112, the inside of the middle case 116, and the inside of the lower case 118.

The propeller shaft 135 is a rod-shaped member that is arranged in an attitude extending in the front-rear direction at a height relatively lower than the outboard motor main body 110. The propeller shaft 135 rotates together with the propeller 111. The front end of the propeller shaft 135 is housed in the lower case 118, and the rear end of the propeller shaft 135 protrudes rearward from the lower case 118.

A gear is provided at the lower end of the drive shaft 133 and at the front end of the propeller shaft 135, respectively. The rotation of the drive shaft 133 is transmitted to the propeller shaft 135 by meshing the gears of the drive shaft 133 and the propeller shaft 135.

The propeller 111 is a rotating member with multiple blades and is attached to the rear end of the propeller shaft 135. The propeller 111 rotates along with the rotation of the propeller shaft 135 about the rotation axis Ap. The propeller 111 generates thrust to propel the boat 10 by rotating.

The steering mechanism 140 controls changes in the traveling direction of the boat 10. The steering mechanism 140 includes a steering shaft 141. The steering shaft 141 is a hollow tubular member arranged to surround the outer circumference of the drive shaft 133. At least a portion of the steering shaft 141 is housed in the middle case 116 and is supported so as to be rotatable about the rotation axis As. The lower portion of the steering shaft 141 protrudes downward from the middle case 116 and is connected to the lower case 118. The steering shaft 141 rotates about the rotation axis As, for example, by the driving force of the drive motor (not shown) housed in the middle case 116. When the steering shaft 141 rotates, the lower case 118 connected to the steering shaft 141 also rotates, and the direction of the propeller 111 is changed. This changes the direction of the thrust generated by the propeller 111 to enable the steering of the boat 10.

The suspension device 150 attaches the outboard motor main body 110 to the hull 200. The suspension device 150 includes a pair of left and right clamp brackets 152, a tilt shaft 154, and a swivel bracket 156.

The pair of left and right clamp brackets 152 are disposed behind the hull 200 in a state separated from each other in the left-right direction and are fixed to the transom 210 of the hull 200 by using, e.g., bolts.

The tilt shaft 154 is a rod-shaped member and is rotatably supported by the clamp brackets 152. The tilt axis At, which is the center line of the tilt shaft 154, defines the horizontal (left-right) axis of the outboard motor 100 during tilting.

The swivel bracket 156 is sandwiched between the pair of clamp brackets 152 and is supported by the clamp brackets 152 via the tilt shaft 154 so as to be rotatable about the tilt axis At. The swivel bracket 156 is driven to rotate about the tilt axis At relative to the clamp bracket 152 by a tilting device (not shown) that includes an actuator such as a hydraulic cylinder.

When the swivel bracket 156 rotates about the tilt axis At with respect to the clamp bracket 152, the outboard motor main body 110 supported by the swivel bracket 156 also rotates about the tilt axis At. This achieves the tilting operation of rotating the outboard motor main body 110 in the upper-lower direction with respect to the hull 200. By this tilting operation, the outboard motor 100 can change the angle of the outboard motor main body 110 about the tilt axis At in the range from the tilt-down state in which the propeller 111 is disposed under the water (the state in which the outboard motor 100 is in the reference attitude) to the tilt-up state in which the propeller 111 is disposed above the water surface. Trimming operation to adjust the attitude of the boat 10 during travel can also be performed by adjusting the angle about the tilt axis At of the outboard motor main body 110.

Figure 3:
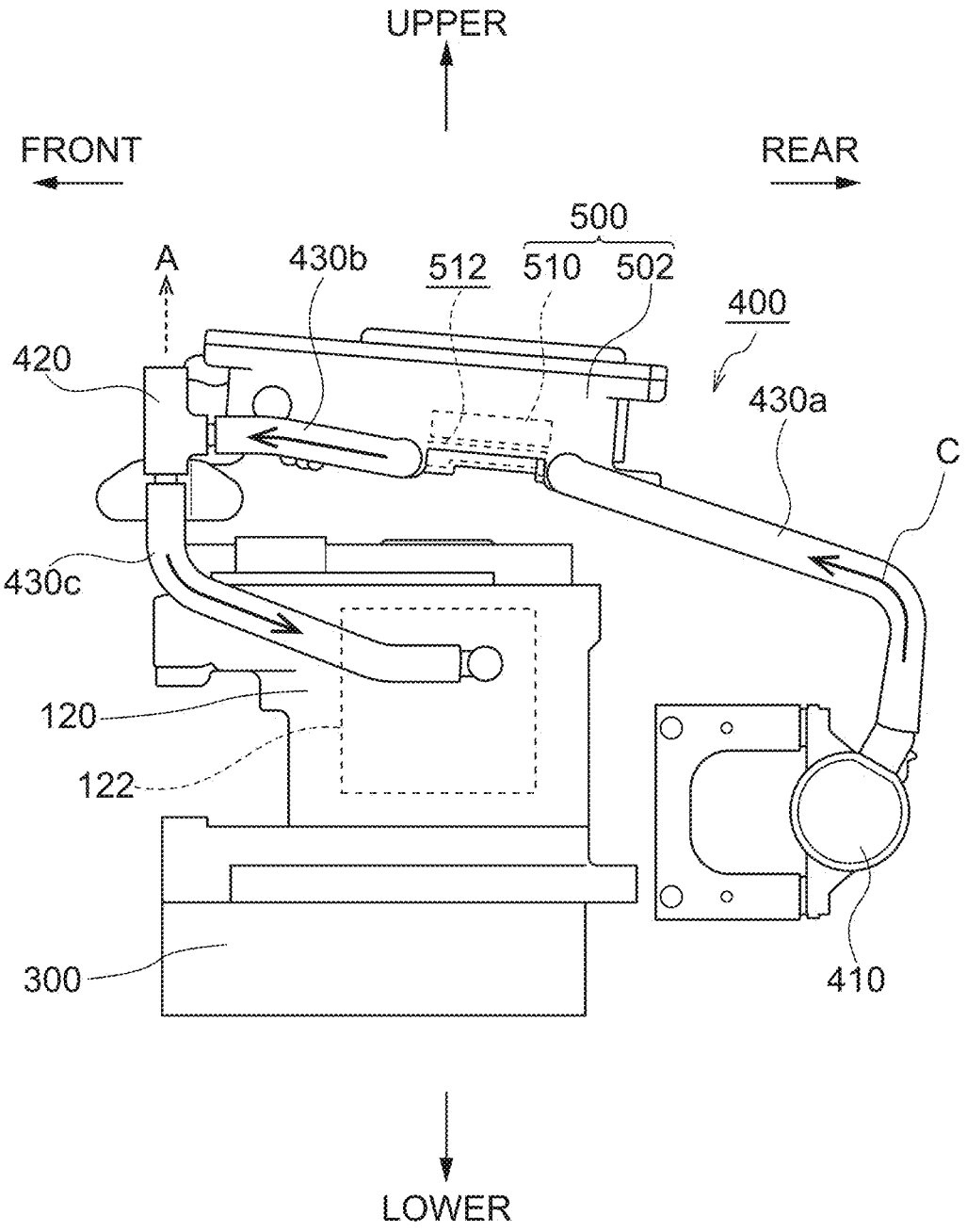
FIG. 3 is an explanatory view schematically illustrating a portion of an internal configuration of an outboard motor main body.
Figure 4:
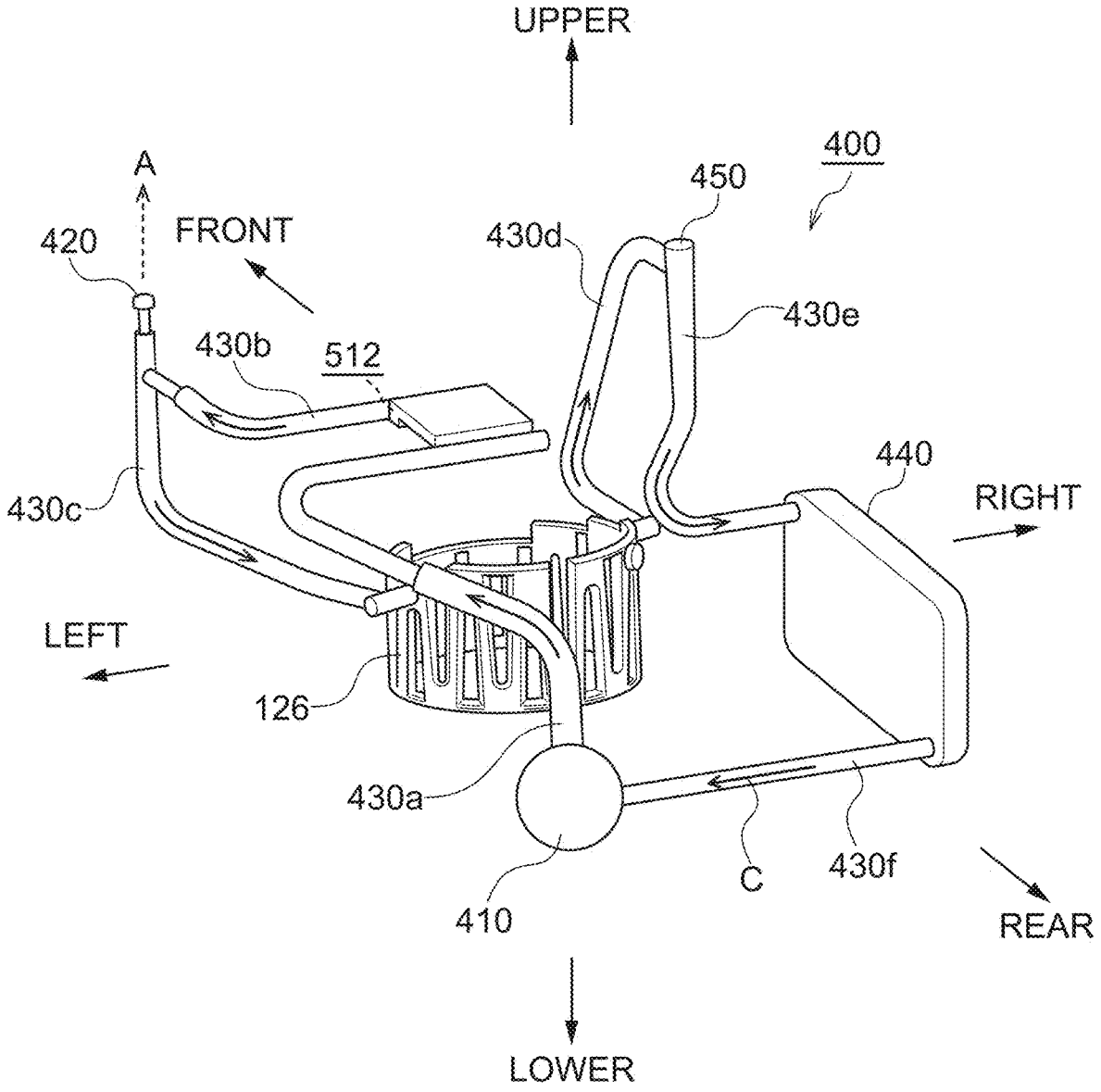
FIG. 4 is an explanatory view schematically illustrating the configuration of an overall coolant flow path.

FIG. 3 is an explanatory view schematically illustrating a portion of the internal configuration of the outboard motor main body 110. FIG. 4 is an explanatory view schematically illustrating the configuration of an overall coolant flow path 400. FIGS. 3 and 4 show the internal structure housed inside the waterproof case 112. As shown in FIGS. 3 and 4, the outboard motor 100 is provided with an overall coolant flow path 400, which is a series of flow paths through which coolant liquid C circulates.

The coolant liquid C circulates inside the outboard motor main body 110 to cool the electric motor 122 and the MCU 510 described below. The coolant liquid C is an antifreeze solution mainly including, e.g., ethylene glycol or propylene glycol. The coolant liquid C is an example of the coolant.

As shown in FIG. 3, the control assembly 500 includes a control case 502, a motor control unit (MCU) 510, and a power supply line 520 (see FIG. 2). The MCU 510 is a circuit board that controls the rotation of the electric motor 122 and the like. The control case 502 houses the MCU 510. Inside the control case 502, there is a space 512 that is a flow path for the coolant liquid C. In other words, the overall coolant flow path 400 includes the space 512 inside the control case 502. The power supply line 520 supplies power to the MCU 510 from a battery or the like (not shown) in the hull 200.

As shown in FIG. 4, the outboard motor 100 further includes a motor cooling device 126, an air vent 420, a filler 450, a heat exchanger 440, a pump 410, and multiple coolant tubes 430*a* to 430*f*.

The motor cooling device 126 has a ring-shaped configuration when viewed in the upper-lower direction and surrounds the outer circumference of the electric motor 122. Inside the motor cooling device 126, a space is provided that is a flow path for the coolant liquid C. In other words, the overall coolant flow path 400 includes the space inside the motor cooling device 126.

The air vent 420 includes an opening to release air that has mixed into the overall coolant flow path 400 to the atmosphere. By removing air from the overall coolant flow path 400, the air vent 420 improves the cooling efficiency of the electric motor 122 and the MCU 510. The air vent 420 is located at an uppermost portion of the overall coolant flow path 400.

The filler 450 includes an opening that functions as a filling port for the coolant liquid C in the overall coolant flow path 400. The opening of the filler 450 also has a function to release air that has mixed into the overall coolant flow path 400 to the atmosphere. The filler 450 is at a relatively higher location in the overall coolant flow path 400, and more specifically, it is located higher than the electric motor 122 and the motor cooling device 126.

The heat exchanger 440 is a device in which heat exchange occurs between the coolant liquid C and seawater that is pumped up from outside the outboard motor 100 by a pump (not shown). The coolant liquid C becomes relatively hot as it passes near the electric motor 122 and the MCU 510 and is cooled by exchanging heat with seawater in the heat exchanger 440. The detailed configuration of the heat exchanger 440 is described below.

The pump 410 pumps the coolant liquid C. The pump 410 is connected to the coolant tube 430*a* described below and the coolant tube 430*f* described below. The coolant liquid C circulates through the overall coolant flow path 400 by the operation of the pump 410. The pump 410 is located relatively lower in the overall coolant flow path 400, and more specifically, it is located at a height lower than the MCU 510 and the control case 502.

The multiple coolant tubes 430*a* to 430*f* are tubular structures that are hollow from one end to the other end, and the space inside each structure defines at least a portion of the overall coolant flow path 400. Each of the coolant tubes 430*a* to 430*f* is configured such that the coolant liquid C flows from one end to the other end by the operation of the pump 410.

The coolant tube 430*a* defines a portion of the overall coolant flow path 400 that extends from the pump 410 to the control case 502. One end of the coolant tube 430*a* is connected to the pump 410 to communicate with the flow path of the coolant liquid C in the pump 410. The other end of the coolant tube 430*a* is connected to the control case 502 to communicate with the space 512 of the control case 502.

The coolant tube 430*b* defines a portion of the overall coolant flow path 400 that extends from the control case 502 to the air vent 420. One end of the coolant tube 430*b* is connected to the control case 502 to communicate with the space 512 of the control case 502. In addition, the other end of the coolant tube 430*b* is connected to the end of one end of the coolant tube 430*c* to communicate with the coolant tube 430*c*. In addition, the lower end of the coolant tube 430*b* (the lowest portion of the coolant tube 430*b*) is connected to the control case 502.

The coolant tube 430*c* defines a portion of the overall coolant flow path 400 that extends from the air vent 420 to the motor cooling device 126. One end of the coolant tube 430*c* is connected to the air vent 420. The other end of the coolant tube 430*c* is connected to the motor cooling device 126 to communicate with the space inside the motor cooling device 126.

The coolant tube 430*d* defines a portion of the overall coolant flow path 400 that extends from the motor cooling device 126 to the filler 450. One end of the coolant tube 430*d* is connected to the motor cooling device 126 to communicate with the space inside the motor cooling device 126. In addition, the other end of the coolant tube 430*d* is connected to the end of one end of the coolant tube 430*e* to communicate with the coolant tube 430*e*. The lower end of the coolant tube 430*d* (the lowest portion in the coolant tube 430*d*) is connected to the motor cooling device 126.

The coolant tube 430*e* defines a portion of the overall coolant flow path 400 that extends from the filler 450 to the heat exchanger 440. One end of the coolant tube 430*e* is connected to the filler 450. The other end of the coolant tube

430*e* is connected to the heat exchanger 440 to communicate with the flow path of the coolant liquid C in the heat exchanger 440.

The coolant tube 430*f* defines a portion of the overall coolant flow path 400 that extends from the heat exchanger 440 to the pump 410. One end of the coolant tube 430*f* is connected to the heat exchanger 440 to communicate with the flow path of the coolant liquid C in the heat exchanger 440. The other end of the coolant tube 430*f* is connected to the pump 410 to communicate with the flow path of the coolant liquid C in the pump 410.

The overall coolant flow path 400 is configured such that the coolant liquid C pumped by the pump 410 flows in the order of the MCU 510, the air vent 420, the motor cooling device 126, the filler 450, and the heat exchanger 440, and then circulates back to the pump 410.

Specifically, first, the coolant liquid C flows out of the pump 410, passes through the coolant tube 430*a*, and flows into space 512. The coolant liquid C that flows into space 512 flows near the MCU 510 to cool the MCU 510.

Next, the coolant liquid C flows out of the space 512, passes through the coolant tube 430*b*, and flows into the coolant tube 430*c* to flow near the air vent 420. If air has been mixed into the coolant liquid C at this time, the air flows towards the air vent 420, which is located higher than the connection between the coolant tubes 430*b*, 430*c* and is released to the atmosphere via the air vent 420 (arrow A in FIGS. 3 and 4).

Next, the coolant liquid C passes through the coolant tube 430*c* and flows into the space inside the motor cooling device 126. The coolant liquid C that flows into the space inside the motor cooling device 126 flows near the electric motor 122 to cool the electric motor 122.

Next, the coolant liquid C flows out of the space inside the motor cooling device 126, passes through the coolant tube 430*d*, and flows into the coolant tube 430*e* to flow near the filler 450. If air has been mixed into the coolant liquid C at this time, the air flows towards the filler 450, which is located higher than the connection between the coolant tubes 430*d* and 430*e*, and is released to the atmosphere via the filler 450 (arrow A in FIGS. 3 and 4).

Next, the coolant liquid C passes through the coolant tube 430*e* and flows into the heat exchanger 440. In the heat exchanger 440, the coolant liquid C is cooled by exchanging heat with seawater pumped in from outside the outboard motor 100.

Next, the coolant liquid C flows out of the heat exchanger 440, passes through the coolant tube 430*f*, and flows into the pump 410. Thus, the coolant liquid C circulates through the overall coolant flow path 400.

Figure 5:
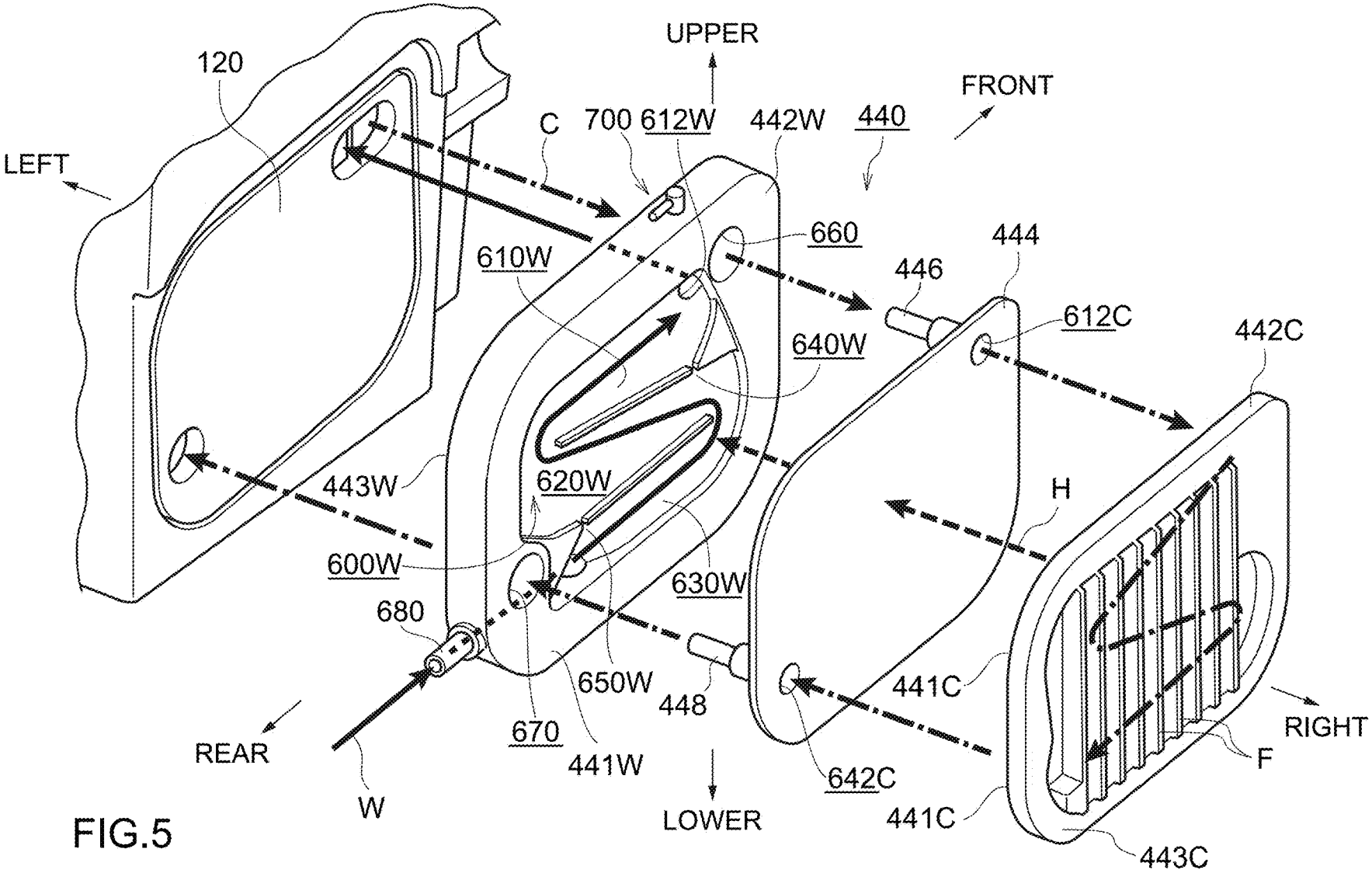
FIG. 5 is an exploded view illustrating the heat exchanger.

FIG. 5 is an exploded view illustrating the heat exchanger 440. As shown in FIG. 5, the heat exchanger 440 is disposed, e.g., on a side of the motor assembly 120. The heat exchanger 440 includes a water channel body 442W, a coolant channel body 442C, and a heat exchange plate 444. A water flow path 600W is provided inside the water channel body 442W, through which seawater W flows. Inside the coolant channel body 442C, a coolant flow path 600C is provided through which coolant liquid C flows (see FIG. 6 below). The heat exchange plate 444 is located between the water channel body 442W and the coolant channel body 442C to perform heat exchange between the water channel body 442W and the coolant channel body 442C.

The heat exchange plate 444 is a flat plate-shaped member disposed orthogonally to the facing direction of the water channel body 442W and the coolant channel body 442C and is made of a material having high thermal conductivity, such as, e.g., metal.

Figure 6:
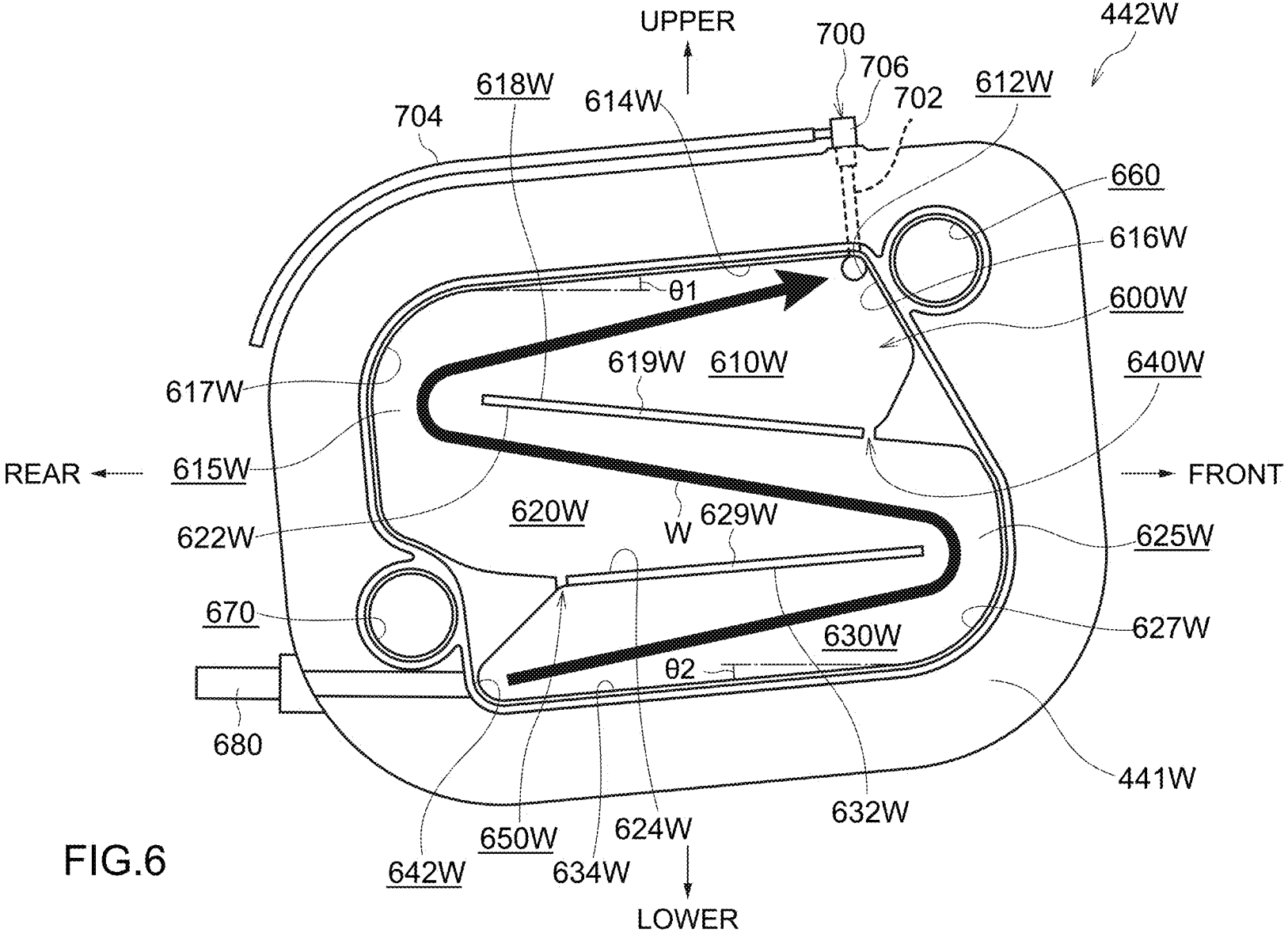
FIG. 6 is an explanatory view illustrating a detailed configuration of a water channel body.

FIG. 6 is an explanatory view illustrating a detailed configuration of a water channel body 442W. The water channel body 442W as a whole has a substantially flat plate shape. FIG. 6 shows the configuration of the inner side 441W of the water channel body 442W that faces the heat exchange plate 444. A groove defining the water flow path 600W is provided in this inner side 441W, and the heat exchange plate 444 is arranged to cover the inner side 441W including this groove. In other words, the water flow path 600W includes the groove in the water channel body 442W and the left surface of the heat exchange plate 444, and the seawater W circulating in the water flow path 600W is in direct contact with the heat exchange plate 444. The groove in the water channel body 442W may hereinafter be referred to as the water flow path 600W.

The water flow path 600W is an S-shaped flow path as a whole and includes an upper flow path 610W, a middle flow path 620W, a lower flow path 630W, an upper bent connector 615W, and a lower bent connector 625W. The upper flow path 610W is an example of the first flow path, the middle flow path 620W is an example of the second and fourth flow paths, and the lower flow path 630W is an example of the third flow path. The upper bent connector 615W is an example of the first bent connector and the lower bent connector 625W is an example of the second bent connector.

The upper flow path 610W is located at the uppermost level in the water flow path 600W and extends in a substantially straight line in a direction intersecting the upper-lower direction (e.g., the horizontal or substantially horizontal direction). The lower flow path 630W is located at the lowermost level in the water flow path 600W and extends in a substantially straight line in a direction intersecting the upper-lower direction (e.g., the horizontal or substantially horizontal direction). The middle flow path 620W is located between the upper flow path 610W and the lower flow path 630W in the upper-lower direction and extends in a substantially straight line in a direction intersecting the upper-lower direction (e.g., the horizontal or substantially horizontal direction). The upper flow path 610W, the middle flow path 620W, and the lower flow path 630W are arranged to overlap each other when viewed in the upper-lower direction.

The upper bent connector 615W connects the ends (rear ends) of the upper flow path 610W and the middle flow path 620W on the same directional side. The outer circumference 617W of the upper bent connector 615W is arcuate. The lower bent connector 625W connects the ends (front ends) of the middle flow path 620W and the lower flow path 630W on the same directional side. The outer circumference 627W of the lower bent connector 625W is arcuate.

The upper flow path 610W is provided with an outlet hole 612W connected to the outside of the heat exchanger 440. The outlet hole 612W is connected to a discharge tube (not shown) to discharge the seawater W to the outside of the outboard motor 100. Upper surfaces 614W, 616W defining the upper flow path 610W are inclined upward at an angle toward the outlet hole 612W. The outlet hole 612W is an example of the first connecting hole. Specifically, the outlet hole 612W is located at the highest position in the water flow path 600W and penetrates or extends from the groove described above defining the water flow path 600W to an outer side 443W of the water channel body 442W. In other words, the outlet hole 612W faces the upper surfaces 614W, 616W.

The outlet hole 612W is provided on the end (front end) opposite to the upper bent connector 615W. The first upper surface 614W is inclined continuously and linearly upward at an angle from a location adjacent to the outer circumference 617W of the upper bent connector 615W toward the outlet hole 612W. The second upper surface 616W is located opposite the first upper surface 614W with respect to the outlet hole 612W and is inclined continuously and linearly upward at an angle toward the outlet hole 612W. The slope of the first upper surface 614W (e.g., the inclination angle θ1 is about 5 degrees or more, for example) is less inclined than that of the second upper surface 616W.

The upper surface 622W of the middle flow path 620W is inclined upward at an angle toward the upper bent connector 615W. The bottom surface 618W of the upper flow path 610W is inclined downward at an angle from the upper bent connector 615W along the upper surface 622W of the middle flow path 620W. The lower end of the bottom surface 618W includes a first through hole 640W that extends to the upper surface 622W of the middle flow path 620W. The bottom surface 618W is an example of the first inclined surface.

Specifically, the upper flow path 610W and the middle flow path 620W are separated by a first partition wall 619W. The first partition wall 619W is straight and inclined upward as it approaches the upper bent connector 615W when viewed in the left-right direction. The lower end of the first partition wall 619W includes a first through hole 640W.

The lower flow path 630W is provided with an inlet hole 642W connected to the outside of the heat exchanger 440. The inlet hole 642W is provided on the end (rear end) opposite to the lower bent connector 625W. The bottom surface 634W of the lower flow path 630W is inclined downward at an angle toward the inlet hole 642W. The slope of the bottom surface 634W (e.g., the inclination angle θ2 is about 5 degrees or more, for example) is identical or substantially identical to the slope of the first upper surface 614W of the upper flow path 610W described above. The inlet hole 642W is connected to a supply tube 680 through which the seawater W pumped by the above-mentioned pump is distributed. The inlet hole 642W is an example of the second connecting hole and the supply tube 680 is an example of the water tube.

The upper surface 632W of the lower flow path 630W is inclined upward at an angle toward the lower bent connector 625W. The bottom surface 624W of the middle flow path 620W is inclined downward at an angle from the lower bent connector 625W along the upper surface 632W of the lower flow path 630W. The lower end of the bottom surface 624W includes a second through hole 650W that extends to the upper surface 632W of the lower flow path 630W. The bottom surface 624W is an example of the second inclined surface. Specifically, the lower flow path 630W and the middle flow path 620W are separated by a second partition wall 629W. The second partition wall 629W is straight and inclined upward as it approaches the lower bent connector 625W when viewed in the left-right direction. The lower end of the second partition wall 629W includes a second through hole 650W.

Figure 7:
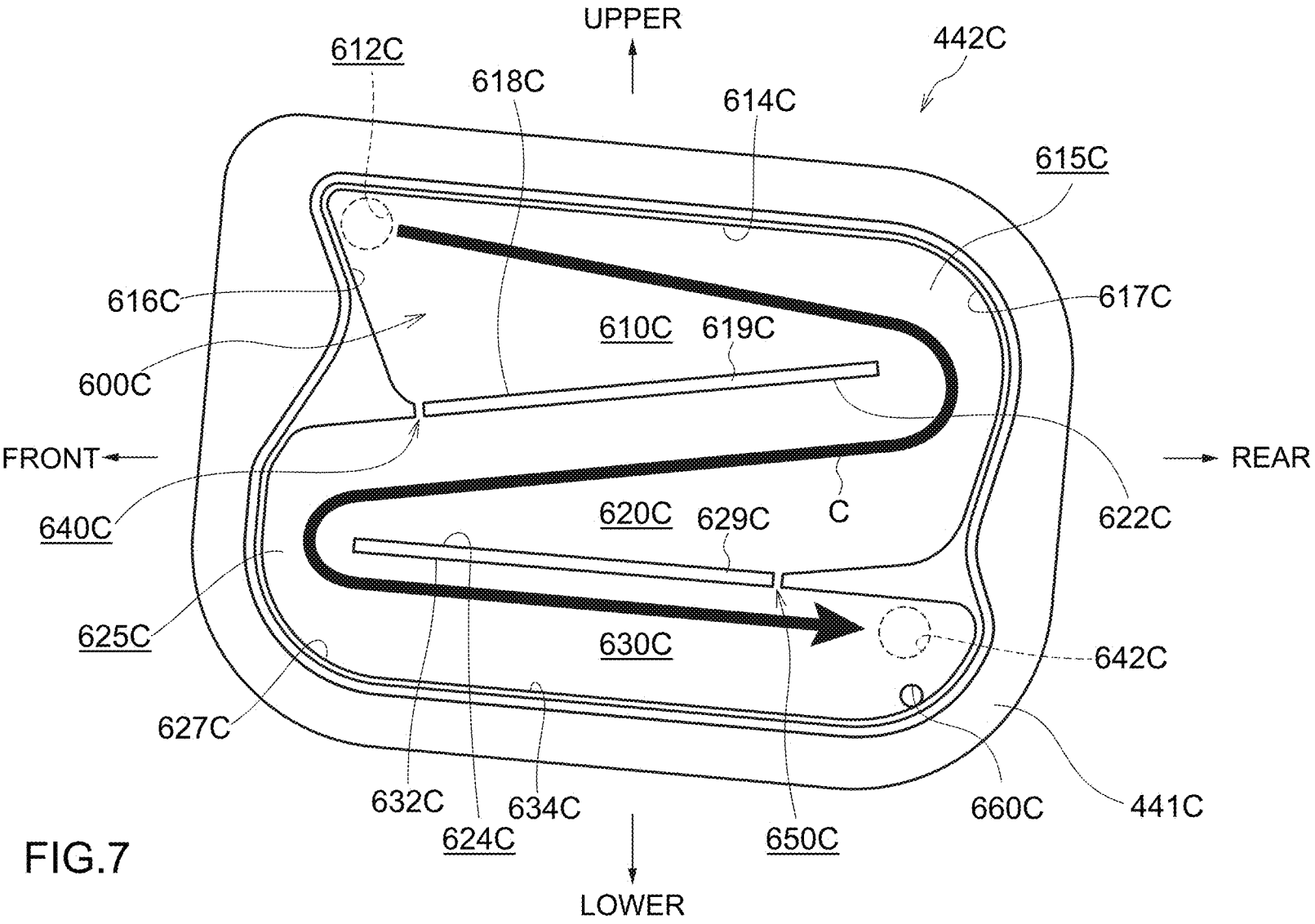
FIG. 7 is an explanatory view illustrating a detailed configuration of a coolant channel body.

FIG. 7 is an explanatory view illustrating a detailed configuration of a coolant channel body 442C. The coolant channel body 442C as a whole has a substantially flat plate shape. FIG. 7 shows the configuration of the inner side 441C of the coolant channel body 442C that faces the heat exchange plate 444. A groove defining the coolant flow path 600C is provided in the inner side 441C, and the heat exchange plate 444 is arranged to cover the inner side 441C including this groove. In other words, the coolant flow path 600C includes the groove in the coolant channel body 442C and the right side of the heat exchange plate 444, and the coolant liquid C circulating in the coolant flow path 600C is in direct contact with the heat exchange plate 444. The groove in the coolant channel body 442C may hereinafter be referred to as the coolant flow path 600C. A plurality of cooling fins F are provided on the outer side 443C of the coolant channel body 442C (see FIG. 5).

The coolant flow path 600C is an S-shaped flow path as a whole and includes an upper flow path 610C, a middle flow path 620C, a lower flow path 630C, an upper bent connector 615C, and a lower bent connector 625C. The upper flow path 610C is an example of the first flow path, the middle flow path 620C is an example of the second and fourth flow paths, and the lower flow path 630C is an example of the third flow path. The upper bent connector 615C is an example of the first bent connector and the lower bent connector 625C is an example of the second bent connector.

The upper flow path 610C is located at the uppermost level in the coolant flow path 600C and extends in a substantially straight line in a direction intersecting the upper-lower direction (e.g., the horizontal or substantially horizontal direction). The lower flow path 630C is located at the lowermost level in the coolant flow path 600C and extends in a substantially straight line in a direction intersecting the upper-lower direction (e.g., the horizontal or substantially horizontal direction). The middle flow path 620C is located between the upper flow path 610C and the lower flow path 630C in the upper-lower direction and extends in a substantially straight line in a direction intersecting the upper-lower direction (e.g., the horizontal or substantially horizontal direction). The upper flow path 610C, the middle flow path 620C, and the lower flow path 630C are arranged to overlap each other when viewed in the upper-lower direction.

The upper bent connector 615C connects the ends (rear ends) of the upper flow path 610C and the middle flow path 620C on the same directional side. The outer circumference 617C of the upper bent connector 615C is arcuate. The lower bent connector 625C connects the ends (front ends) of the middle flow path 620C and the lower flow path 630C on the same directional side. The outer circumference 627C of the lower bent connector 625C is arcuate.

The upper flow path 610C is provided with an inlet hole 612C connected to the outside of the heat exchanger 440. An upper surface 614C defining the upper flow path 610C is inclined upward at an angle toward the inlet hole 612C. The inlet hole 612C is an example of the first connecting hole. Specifically, the inlet hole 612C is located at the highest position in the coolant flow path 600C and extends to the heat exchange plate 444 defining the coolant flow path 600C (see FIG. 5). The inlet hole 612C is connected to the coolant tube 430*e* described above. In an example embodiment, the heat exchange plate 444 includes a tubular portion 446 protruding toward the water channel body 442W, and the inlet hole 612C is connected to the tubular portion 446. The tubular portion 446 is connected to the coolant tube 430*e* via an insertion hole 660 provided in the water channel body 442W.

The inlet hole 612C is provided on the end (front end) opposite to the upper bent connector 615C. The upper surface 614C is inclined continuously and linearly upward at an angle from a location adjacent to the outer circumference 617C of the upper bent connector 615C to the inlet hole 612C. The side surface 616C defining the coolant flow path 600C is also inclined continuously and linearly upward at an angle toward the inlet hole 612C. The slope of the upper surface 614C (e.g., the inclination angle θ1 is about 5 degrees or more, for example) is inclined less than that of the side surface 616C.

The upper surface 622C of the middle flow path 620C is inclined upward at an angle toward the upper bent connector 615C. The bottom surface 618C of the upper flow path 610C is inclined downward from the upper bent connector 615C along the upper surface 622C of the middle flow path 620C. The lower end of the bottom surface 618C includes a first through hole 640C that extends to the upper surface 622C of the middle flow path 620C. The bottom surface 618C is an example of the first inclined surface.

Specifically, the upper flow path 610C and the middle flow path 620C are separated by the first partition wall 619C. The first partition wall 619C is straight and inclined upward as it approaches the upper bent connector 615C when viewed in the left-right direction. The lower end of the first partition wall 619C includes a first through hole 640C.

The lower flow path 630C is provided with an outlet hole 642C connected to the outside of the heat exchanger 440 and a coolant drain hole 660C connected to the outside of the heat exchanger 440. The outlet hole 642C and the coolant drain hole 660C are provided on the end (rear end) opposite to the lower bent connector 625C. The coolant drain hole 660C is located lower than the outlet hole 642C. The bottom surface 634C of the lower flow path 630C is inclined downward at an angle toward the coolant drain hole 660C. The slope of the bottom surface 634C (e.g., the inclination angle θ2 is about 5 degrees or more, for example) is identical or substantially identical to the slope of the upper surface 614C of the upper flow path 610C described above. The coolant drain hole 660C is used to discharge the coolant liquid C in the coolant flow path 600C. The outlet hole 642C is connected to the coolant tube 430*f* described above. In an example embodiment, the heat exchange plate 444 includes a tubular portion 448 protruding toward the water channel body 442W, and the outlet hole 642C is connected to the tubular portion 448. The tubular portion 448 is connected to the coolant tube 430*f* via an insertion hole 670 in the water channel body 442W. The coolant drain hole 660C is an example the second connecting hole.

The upper surface 632C of the lower flow path 630C is inclined upward at an angle toward the lower bent connector 625C. The bottom surface 624C of the middle flow path 620C is inclined downward at an angle from the lower bent connector 625C along the upper surface 632C of the lower flow path 630C. The lower end of the bottom surface 624C includes a second through hole 650C that extends to the upper surface 632C of the lower flow path 630C. The bottom surface 624C is an example of the second inclined surface.

Specifically, the lower flow path 630C and the middle flow path 620C are separated by a second partition wall 629C. The second partition wall 629C is straight and inclined upward as it approaches the lower bent connector 625C when viewed in the left-right direction. The lower end of the second partition wall 629C includes a second through hole 650C. The water flow path 600W and the coolant flow path 600C have a substantially identical shape (S-shape) when viewed in the left-right direction.

The water channel body 442W further includes a secondary discharge tube 700 (see FIGS. 5 and 6). The secondary discharge tube 700 includes an inner tube 702 and an outer tube 704. The inner tube 702 is inside the heat exchanger 440 (the water channel body 442W). The inner tube 702 extends continuously upward from the highest location in the water flow path 600W (the top of the upper surfaces 614W, 616W) and extends to the outer circumference of the water channel body 442W. The outer tube 704 is disposed outside of the heat exchanger 440 (the water channel body 442W). One end of the outer tube 704 is connected to the inner tube 702 through a connecting member 706. The other end of the outer tube 704 opens to an atmospheric space outside the heat exchanger 440. The outer tube 704 becomes continuously lower as it approaches the other end that opens from one end connected to the connecting member 706. In other words, the secondary discharge tube 700 includes a portion (the connecting member 706) located higher than the outlet hole 612W and further includes a discharging portion (the inner tube 702) that opens into the water flow path 600W with that portion as the highest location and a discharging portion (the outer tube 704) that opens into the atmospheric space with that portion as the highest location.

As explained above, the outboard motor 100 includes the drive source, the coolant tubes 430*a* to 430*f*, the water tubes (the supply tube 680, discharge tube, and the like), and the heat exchanger 440. The drive source includes the electric motor 122. The coolant tubes 430*a* to 430*f* define at least a portion of the overall coolant flow path 400 in which the coolant liquid C circulates to cool the electric motor 122 and the MCU 510. External water flows through the water tubes. The heat exchanger 440 is internally provided with the coolant flow path 600C through which the coolant liquid C from the coolant tubes 430*a* to 430*f* flows and the water flow path 600W through which the seawater W from the water tubes flows.

In an example embodiment, the water flow path 600W is an S-shaped flow path as a whole and includes the upper flow path 610W, the middle flow path 620W, the lower flow path 630W, the upper bent connector 615W, and the lower bent connector 625W (see FIG. 6). Therefore, the efficiency of heat exchange in the heat exchanger 440 is improved by the amount of the seawater W circulating in the heat exchanger 440 compared to a configuration in which the water flow path 600W has, e.g., a straight shape as a whole.

In an example embodiment, the upper flow path 610W of the water flow path 600W is provided with the outlet hole 612W connected to the outside of the heat exchanger 440. In addition, the upper surfaces 614W, 616W defining the upper flow path 610W are inclined upward at an angle toward the outlet hole 612W (see FIG. 6). Therefore, air is reduced or prevented from being trapped in the upper flow path 610W compared to, e.g., a configuration in which the upper surfaces defining the upper flow path 610W extend along the horizontal direction or a configuration in which the upper surface is inclined upward at an angle toward a closed portion different from the outlet hole 612W.

In this configuration, the upper surface 622W of the middle flow path 620W is inclined upward at an angle toward the upper bent connector 615W (see FIG. 6). This reduces or prevents air from being trapped in the middle flow path 620W. The upper surface 632W of the lower flow path 630W is inclined upward at an angle toward the lower bent connector 625W (see FIG. 6). This reduces or prevents air from being trapped in the lower flow path 630W. In other words, the upper surfaces 622W, 632W of the second and the lower flow paths 620W, 630W from the top in the water flow path 600W are all inclined upward at an angle toward the bent connectors 615W, 625W.

During operation of the heat exchanger 440, the water channel body 442W allows the seawater W pumped into the supply tube 680 to flow through the inlet hole 642W at the lower end of the water flow path 600W, and the seawater W accumulates in the water flow path 600W in the order of the lower flow path 630W, the middle flow path 620W, and the upper flow path 610W. With respect to this, as described above, the upper surfaces 614W, 616W defining the upper flow path 610W are inclined upward at an angle toward the outlet hole 612W, and the upper surfaces 622W, 632W of the flow paths 620W, 630W of the second and lower stages are all inclined upward at an angle toward the bent connectors 615W, 625W. Therefore, during operation of the heat exchanger 440, air is reduced or prevented from being trapped in the water flow path 600W, and the entire water flow path 600W can be filled with the seawater W.

In an example embodiment, the outlet hole 612W is provided on the end (front end) opposite to the upper bent connector 615W (see FIG. 6). That is, the outlet hole 612W is located at a high position in the upper bent connector 615W (the water flow path 600W). Therefore, the outlet hole 612W can be an air vent hole without providing a separate hole.

The bottom surface 634W of the lower flow path 630W is inclined downward at an angle toward the inlet hole 642W (see FIG. 6). This reduces or prevents the seawater W from remaining in the lower flow path 630W compared to, e.g., a configuration in which the bottom surface of the lower flow path 630W extends along a horizontal direction or a configuration in which the bottom surface is inclined downward toward a closed portion different from the inlet hole 642W.

In an example embodiment, the bottom surface 618W of the upper flow path 610W is inclined downward along the upper surface 622W of the middle flow path 620W from the upper bent connector 615W. The lower end of the bottom surface 618W is provided with the first through hole 640W that extends to the upper surface 622W of the middle flow path 620W (see FIG. 6). Therefore, this increases the capacity of the upper flow path 610W to accommodate the seawater W while reducing or preventing the seawater W from remaining in the upper flow path 610W when the heat exchanger 440 is stopped compared to a configuration in which the bottom surface of the upper flow path 610W is inclined upward at an angle from the upper bent connector 615W.

In an example embodiment, the bottom surface 624W of the middle flow path 620W is inclined downward at an angle from the lower bent connector 625W to the upper surface 632W of the lower flow path 630W. The lower end of the bottom surface 624W is provided with the second through hole 650W that extends to the upper surface 632W of the lower flow path 630W (see FIG. 6). This increases the capacity of the middle flow path 620W to accommodate the seawater W while reducing or preventing the seawater W from remaining in the middle flow path 620W when the heat exchanger 440 is stopped.

When the heat exchanger 440 is stopped, the water channel body 442W is configured so that the seawater W accumulated in the water flow path 600W escapes from the upper flow path 610W, the middle flow path 620W, and the lower flow path 630W, in that order. As described above, the bottom surface 634W of the lower flow path 630W is inclined downward at an angle toward the inlet hole 642W. The bottom surfaces 618W, 624W of the second and higher level flow paths 610W, 620W from the bottom are inclined downward at an angle along the upper surfaces 622W, 632W of the flow paths 620W, 630W one level below the bent connector 615W, 625W. The lower end of bottom surfaces 618W, 624W are provided with the through holes 640W and 650W. This reduces or prevents the seawater W from remaining in the water flow paths 600W when the heat exchanger 440 is stopped.

Figures 8A, 8B, 8C:
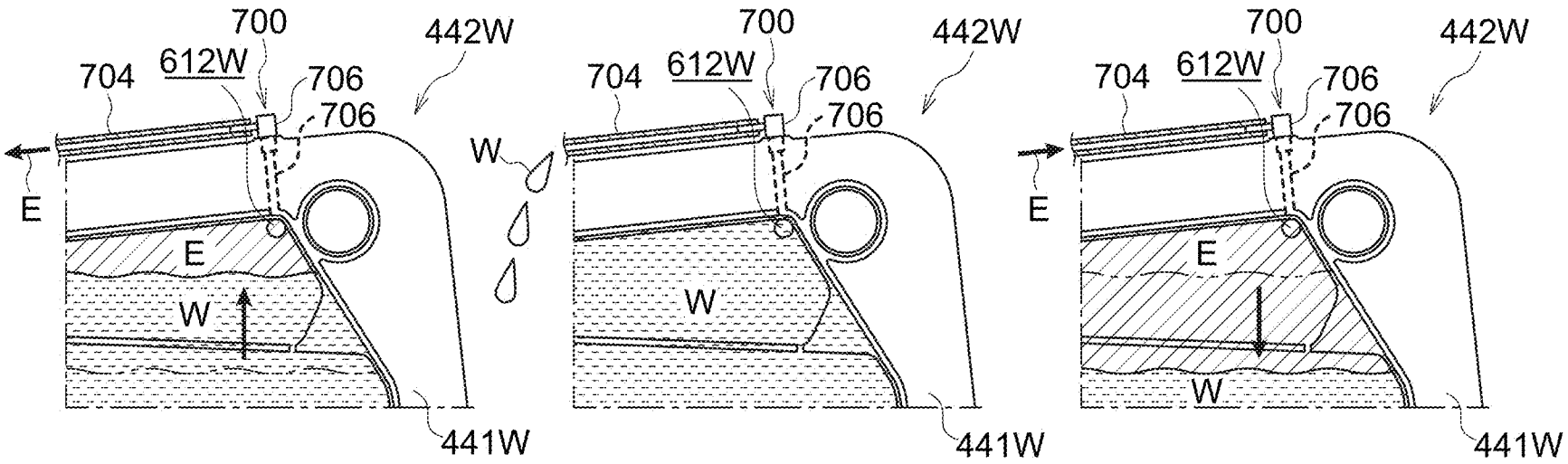
FIGS. 8A to 8C are explanatory views of the functions of a secondary discharge tube.

FIGS. 8A to 8C are explanatory views of the functions of a secondary discharge tube 700. At the beginning of the operation of the heat exchanger 440, the seawater W flows into the water flow path 600W from the supply tube 680, and the water level of the seawater W in the water flow path 600W rises, as shown in FIG. 8A. The heat exchanger 440 includes the secondary discharge tube 700. The secondary discharge tube 700 opens from the inside of the water flow path 600W to the atmospheric space outside the heat exchanger 440, and thus, together with the discharge tube, functions as an air vent that discharges the air E, which is trapped in the upper portion of the water flow path 600W, to the outside of the heat exchanger 440. Therefore, compared to the configuration where the heat exchanger 440 does not have the secondary discharge tube 700, the air E in the water flow path 600W can be smoothly discharged to the outside.

Next, as shown in FIG. 8B, when water flow path 600W is filled with the seawater W, the seawater W is discharged from the discharge tube and also slightly from the secondary discharge tube 700. Subsequently, when the heat exchanger 440 is stopped, the pump 410 stops and the seawater W stops flowing into the water flow path 600W. Then, as shown in FIG. 8C, the seawater W in the water flow path 600W flows backward and the water level of the seawater W in the water flow path 600W begins to drop. At this time, the secondary discharge tube 700 draws the air E from the atmospheric space into the water flow path 600W earlier than the discharge tube as the seawater W inside it is released. Therefore, the seawater W is discharged from the water flow path 600W at a high speed compared to a configuration in which the heat exchanger 440 does not have the secondary discharge tube 700. As a result, e.g., even when the outboard motor 100 is immediately put from the tilt-down state to the tilt-up state after the operation is stopped, the seawater W can be reduced or prevented from remaining in the water flow path 600W.

In an example embodiment, the coolant flow path 600C is an S-shaped flow path as a whole and includes the upper flow path 610C, the middle flow path 620C, the lower flow path 630C, the upper bent connector 615C, and the lower bent connector 625C (see FIG. 7). Therefore, the efficiency of heat exchange in the heat exchanger 440 can be improved by the amount of the coolant liquid C circulating in the heat exchanger 440 compared to a configuration in which the coolant flow path 600C has, e.g., a straight shape as a whole, for example.

In an example embodiment, the upper flow path 610C is provided with the inlet hole 612C connected to the outside of the heat exchanger 440. The upper surface 614C defining the upper flow path 610C is inclined upward at an angle toward the inlet hole 612C. Therefore, this reduces or prevents air from being trapped in the upper flow path 610C compared to, e.g., a configuration in which the upper surface defining the upper flow path 610C extends along a horizontal direction or a configuration in which the upper surface is inclined upward at an angle toward a closed portion different from the inlet hole 612C.

In this configuration, the upper surface 622C of the middle flow path 620C is inclined upward at an angle toward the upper bent connector 615C (see FIG. 7). This reduces or prevents air from being trapped in the middle flow path 620C. The upper surface 632C of the lower flow path 630C is inclined upward at an angle toward the lower bent connector 625C (see FIG. 7). This reduces or prevents air from being trapped in the lower flow path 630C. In other words, the upper surfaces 622C, 632C of the second or lower flow paths 620C, 630C from the top in the coolant flow path 600C are all inclined upward at an angle toward the bent connectors 615C, 625C. Therefore, e.g., at the time of replenishing the coolant liquid C to the overall coolant flow path 400, air is reduced or prevented from being trapped in the coolant flow path 600C, and the overall coolant flow path 600C can be filled with the coolant liquid C.

In an example embodiment, the inlet hole 612C is provided on the end (front end) opposite to the upper bent connector 615C (see FIG. 7). That is, the inlet hole 612C is located at a high position in the upper bent connector 615C (the coolant flow path 600C). Therefore, the inlet hole 612C can be used as an air vent hole without providing a separate hole.

The bottom surface 634C of the lower flow path 630C is inclined downward at an angle toward the coolant drain hole 660C (see FIG. 7). This reduces or prevents the coolant liquid C from remaining in the lower flow path 630C when the coolant liquid C is discharged.

In an example embodiment, the bottom surface 618C of the upper flow path 610C is inclined downward at an angle from the upper bent connector 615C to the upper surface 622C of the middle flow path 620C. The lower end of the bottom surface 618C is provided with the first through hole 640C that extends to the upper surface 622C of the middle flow path 620C (see FIG. 7). This increases the capacity of the upper flow path 610C to accommodate the coolant liquid C while reducing or preventing the coolant liquid C from remaining in the upper flow path 610C when the coolant liquid C is discharged.

In an example embodiment, the bottom surface 624C of the middle flow path 620C is inclined downward at an angle from the lower bent connector 625C to the upper surface 632C of the lower flow path 630C. The lower end of the bottom surface 624C is provided with the second through hole 650C that extends to the upper surface 632C of the lower flow path 630C (see FIG. 7). Therefore, this increases the capacity of the middle flow path 620C to accommodate the coolant liquid C while reducing or preventing the coolant liquid C from remaining in the middle flow path 620C when the coolant liquid C is discharged.

In an example embodiment, the flow direction of the seawater W in the water flow path 600W and the flow direction of the coolant liquid C in the coolant flow path 600C are opposite to each other. Therefore, this improves the heat exchange efficiency of the heat exchanger 440 compared to, e.g., a configuration in which the flow direction of the seawater W in the water flow path 600W and the flow direction of the coolant liquid C in the coolant flow path 600C are the same.

The technologies disclosed herein are not limited to the above-described example embodiments and may be modified in various ways without departing from the gist of the present invention, including the following modifications.

The configurations of the boats 10 and the outboard motors 100 of the example embodiments are only examples and may be variously modified. For example, the drive source of the above example embodiments only includes the electric motor 122, but the drive source may include both the electric motor and an engine such as an internal combustion engine.

In the above example embodiments, the MCU 510 is located higher than the electric motor 122, but this is not necessarily the case, and the MCU may be located lower than the electric motor.

In the above example embodiments, there are multiple coolant tubes 430*a* to 430*f*, but it is not necessary to provide the multiple coolant tubes, and only one coolant tube may be provided.

In the above example embodiments, the water flow path is exemplified by the water flow path 600W defined by a groove on the inner side 441W of the water channel body 442W and the heat exchange plate 444, but the water flow path is not limited to this and may be a through channel inside the water channel body 442W. Furthermore, in the above example embodiments, the coolant flow path is exemplified by the coolant flow path 600C defined by a groove on the inner side 441C of the coolant channel body 442C and the heat exchange plate 444, but the coolant flow path is not limited to this and may be a through channel inside the coolant channel body 442C.

In the above example embodiments, both the coolant flow path 600C and the water flow path 600W are provided with two bent connectors, but e.g., they may be provided without a bent connector, with one bent connector, or with three or more bent connectors. The first upper surface 614W may be inclined upward in a stepwise or curvilinear manner toward the outlet hole 612W. The bottom surface 634W of the lower flow path 630W may be inclined upward in a stepwise or curvilinear manner toward the inlet hole 642W. The bottom surface 634C of the lower flow path 630C may be inclined upward in a stepwise or curvilinear manner toward the coolant drain hole 660C. The upper surfaces 632W, 632C of the lower flow paths 630W, 630C may be inclined upward in a stepwise or curvilinear manner toward the lower bent connectors 625W, 625C. The bottom surfaces 624W, 624C of the middle flow paths 620W, 620C may be inclined upward in a stepwise or curvilinear manner from the lower bent connectors 625W, 625C along the upper surfaces 632W, 632C of the lower flow paths 630W, 630C.

In the above example embodiments, the first connecting hole is exemplified by the outlet hole 612W and the inlet hole 612C, but the first connecting hole is not limited to these and may be a through hole that opens into the flow paths (the water flow path 600W, the coolant flow path 600C) at a higher location than the outlet hole 612W and the inlet hole 612C and also opens into the atmospheric space outside the heat exchanger 440. In the above example embodiments, the second connecting hole is exemplified by the inlet hole 642W, but the second connecting hole is not limited to this and may be a through hole that opens into the flow path (the water flow path 600W) at a lower location than the inlet hole 642W and also opens into the atmospheric space outside the heat exchanger 440.

In the above example embodiments, the configuration may be such that the flow direction of the seawater W in the water flow path 600W and the flow direction of the coolant liquid C in the coolant flow path 600C are the same.

In the above example embodiments, the coolant liquid C (antifreeze mainly includes ethylene glycol or propylene glycol) is shown as an example coolant, but the type of coolant is not limited as long as it cools the electric motor and motor control device. In the above example embodiments, the water flow path 600W is configured to be filled with the seawater W by allowing the seawater W to flow in through the inlet hole 642W provided at the lower end of the water flow path 600W. This allows the water flow path 600W to be filled with the seawater W while reducing or preventing air from being trapped in the water flow path 600W, even in a configuration in which the seawater W is filled into the water flow path 600W every time the outboard motor 100 changes from the tilt-up state to the tilt-down state. However, the configuration may be such that the seawater W is allowed to flow in through holes provided at the upper end of the water flow path 600W to fill the water flow path 600W. On the other hand, in the above example embodiments, the coolant liquid C flows in from the inlet hole 612C at the upper end of the coolant flow path 600C. The overall coolant flow path 400 is basically sealed, and there is no need to have the coolant liquid C fill the coolant flow path 600C every time the outboard motor 100 changes from the tilt-up state to the tilt-down state. However, the coolant liquid C may flow in through a hole provided in the lower end of the coolant flow path 600C.

In the above example embodiments, the heat exchanger 440 may be provided without a secondary discharge tube 700. The secondary discharge tube 700 may be configured without the outer tube 704. The inner tube 702 may be configured to extend diagonally upward.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a drive source including an electric motor;

a coolant tube through which a coolant to cool the drive source flows;

a water tube through which water from outside the outboard motor flows; and a heat exchanger including a coolant flow path through which the coolant from the coolant tube flows and a water flow path through which the water from the water tube flows; wherein at least one of the coolant flow path and the water flow path includes:

a first flow path extending in a direction intersecting an upper-lower direction;

a second flow path lower than the first flow path and extending in a direction intersecting the upper-lower direction; and a first bent connector connecting one end of the first flow path and one end of the second flow path; and the first flow path includes a first connecting hole connected to an outside of the heat exchanger, and an upper surface defining the first flow path and inclined upward at an angle toward the first connecting hole.

2. The outboard motor according to claim 1, wherein the first connecting hole is an inlet hole or an outlet hole for the coolant or the water, and is located at an end of the first flow path opposite to the first bent connector.

3. The outboard motor according to claim 1, wherein the upper surface of the second flow path is inclined upward at an angle toward the first bent connector.

4. The outboard motor according to claim 2, wherein the upper surface of the second flow path is inclined upward at an angle toward the first bent connector.

5. The outboard motor according to claim 3, wherein a bottom surface of the first flow path includes a first inclined surface inclined downward at an angle from the first bent connector along the upper surface of the second flow path; and a lower end of the first inclined surface includes a first through hole that extends to the upper surface of the second flow path.

6. The outboard motor according to claim 4, wherein a bottom surface of the first flow path includes a first inclined surface inclined downward at an angle from the first bent connector along the upper surface of the second flow path; and a lower end of the first inclined surface includes a first through hole that extends to the upper surface of the second flow path.

7. The outboard motor according to claim 1, wherein at least one of the coolant flow path and the water flow path includes:

a third flow path extending in a direction intersecting the upper-lower direction;

a fourth flow path higher than the third flow path and extending in a direction intersecting the upper-lower direction; and a second bent connector connecting one end of the third flow path and one end of the fourth flow path; wherein the third flow path includes a second connecting hole at an end opposite to the second bent connector, and a bottom surface of the third flow path is inclined downward at an angle toward the second connecting hole.

8. The outboard motor according to claim 2, wherein at least one of the coolant flow path and the water flow path includes:

a third flow path extending in a direction intersecting the upper-lower direction;

a fourth flow path higher than the third flow path and extending in a direction intersecting the upper-lower direction; and a second bent connector connecting one end of the third flow path and one end of the fourth flow path; wherein the third flow path includes a second connecting hole at an end opposite to the second bent connector, and a bottom surface of the third flow path is inclined downward at an angle toward the second connecting hole.

9. The outboard motor according to claim 3, wherein at least one of the coolant flow path and the water flow path includes:

a third flow path extending in a direction intersecting the upper-lower direction;

a fourth flow path higher than the third flow path and extending in a direction intersecting the upper-lower direction; and a second bent connector connecting one end of the third flow path and one end of the fourth flow path; wherein the third flow path includes a second connecting hole at an end opposite to the second bent connector, and a bottom surface of the third flow path is inclined downward at an angle toward the second connecting hole.

10. The outboard motor according to claim 7, wherein the upper surface of the third flow path is inclined upward at an angle toward the second bent connector.

11. The outboard motor according to claim 10, wherein a bottom surface of the fourth flow path includes a second inclined surface inclined downward at an angle from the second bent connector along the upper surface of the third flow path; and a lower end of the second inclined surface includes a second through hole that extends to the upper surface of the third flow path.

12. The outboard motor according to claim 1, wherein the coolant flow path and the water flow path both include the first flow path, the second flow path, and the first bent connector;

one of the coolant flow path and the water flow path is configured to allow the coolant to flow from the first flow path to the second flow path via the first bent connector; and the other of the coolant flow path and the water flow path is configured to allow the water to flow from the second flow path to the first flow path via the first bent connector.

13. The outboard motor according to claim 2, wherein the coolant flow path and the water flow path both include the first flow path, the second flow path, and the first bent connector;

one of the coolant flow path and the water flow path is configured to allow the coolant to flow from the first flow path to the second flow path via the first bent connector; and the other of the coolant flow path and the water flow path is configured to allow the water to flow from the second flow path to the first flow path via the first bent connector.

14. The outboard motor according to claim 3, wherein the coolant flow path and the water flow path both include the first flow path, the second flow path, and the first bent connector;

one of the coolant flow path and the water flow path is configured to allow the coolant to flow from the first flow path to the second flow path via the first bent connector; and the other of the coolant flow path and the water flow path is configured to allow the water to flow from the second flow path to the first flow path via the first bent connector.

15. The outboard motor according to claim 1, wherein the water flow path includes a water inlet hole at a lower end of the water flow path and a water outlet hole at an upper end of the water flow path; and the outboard motor further comprises:

a discharge tube connected to the outlet hole to discharge the water in the water flow path to the outside of the outboard motor; and a secondary discharge tube extending upward from a location higher than the outlet hole in the water flow path and opening to a space outside the heat exchanger.

16. The outboard motor according to claim 2, wherein the water flow path includes a water inlet hole at a lower end of the water flow path and a water outlet hole at an upper end of the water flow path; and the outboard motor further comprises:

a discharge tube connected to the outlet hole to discharge the water in the water flow path to the outside of the outboard motor; and a secondary discharge tube extending upward from a location higher than the outlet hole in the water flow path and opening to a space outside the heat exchanger.

17. The outboard motor according to claim 3, wherein the water flow path includes a water inlet hole at a lower end of the water flow path and a water outlet hole at an upper end of the water flow path; and the outboard motor further comprises:

a discharge tube connected to the outlet hole to discharge the water in the water flow path to the outside of the outboard motor; and a secondary discharge tube extending upward from a location higher than the outlet hole in the water flow path and opening to a space outside the heat exchanger.

18. A boat comprising;

a hull; and the outboard motor according to claim 1 mounted to a rear portion of the hull.

19. An outboard motor comprising:

a drive source including an electric motor;

a coolant tube through which a coolant to cool the drive source flows;

a water tube through which water from outside the outboard motor flows; and a heat exchanger including a coolant flow path through which the coolant from the coolant tube flows and a water flow path through which the water from the water tube flows; wherein at least one of the coolant flow path and the water flow path includes a connecting hole connected to an outside of the heat exchanger, and an upper surface defining the at least one of the coolant flow path and the water flow path and inclined upward at an angle toward the connecting hole.

* * * * *